United States Patent [19]

Yoneda

[11] Patent Number: 4,664,313

[45] Date of Patent: May 12, 1987

[54] WATER EJECTING GUN

[76] Inventor: Rikizo Yoneda, 64 Shimogano Umenoki-cho, Sakyo-ku, Kyoto-shi, Japan

[21] Appl. No.: 740,551

[22] Filed: Jun. 3, 1985

[51] Int. Cl.[4] ..... B05B 1/32

[52] U.S. Cl. ..... 239/456; 239/383; 239/438; 239/443; 239/480

[58] Field of Search ..... 239/456–458, 239/437–441, 443, 383, 478–481, 581, 582

[56] References Cited

U.S. PATENT DOCUMENTS

| | | | |
|---|---|---|---|
| 641,933 | 1/1900 | Canner | 239/441 |
| 719,849 | 2/1903 | Oberwalder | 239/458 |
| 721,665 | 3/1903 | Busha | 239/441 |
| 801,210 | 10/1905 | Burnett | 239/456 |
| 1,520,820 | 12/1924 | Isaacs | 239/383 |
| 2,307,014 | 1/1943 | Becker et al. | 239/438 |
| 2,416,719 | 3/1947 | Stockdale | 239/480 |
| 2,621,076 | 12/1952 | Barton | 239/480 X |
| 3,363,842 | 1/1968 | Burns | 239/458 X |

*Primary Examiner*—Andres Kashnikow
*Assistant Examiner*—Daniel R. Edelbrock
*Attorney, Agent, or Firm*—Jordan and Hamburg

[57] ABSTRACT

A water ejecting gun simultaneously produces two kinds of ejecting flows, a straight flow and a spray flow. The gun disposes a rotating or spiral fan element in a water passage for producing the spray flow. The straight flow acts as a carrier for the spray flow. A mechanism for producing the spray and straight flows includes an inner sleeve, an outer sleeve rotatably and axially movable on the inner sleeve, a nozzle element disposed in the inner sleeve which defines a main flow passage and a sub-flow passage and a frusto-conical core element engaging the upstream end of the nozzle element to form a variable gap therebetween. When the gap is open, water flows to the main flow passage. When the gap is closed, a smaller water flow to the main flow passage occurs through radial and axial passages in the core element. The straight and spray water flows exit the gun simultaneously through an ejecting opening. Since the spray flow is made of numerous fine water particles, the flow can efficiently extinguish the fire while reducing damages to interiors ordinarly caused by ejected water.

1 Claim, 9 Drawing Figures

WATER EJECTING GUN

BACKGROUND OF THE INVENTION

The present invention relates to a water ejecting gun, and more particularly to a water ejecting gun which can extinguish a fire with the least amount of water while reducing the damage to interiors caused by the ejected water.

Conventionally, fire extinguishing nozzles or guns used for extinguishing fire in various buildings including sky-scrapers usually eject at least 550 liters per minute of water. This tremendous amount of ejected water intrudes not only the room under fire but also many other rooms located below the room under fire, and causes heavy or serious damage to buildings, interiors, clothing, furniture and the like.

Therefore, a fire-extinguishing apparatus which can reduce such damage caused by the ejected water has been clamored for many years.

Accordingly, it is an object of the present invention to provide a water ejecting gun which can enhance the fire extinguishing efficiency while drastically reducing the damage caused by the ejected water.

SUMMARY OF THE INVENTION

In summary, the present invention discloses a water ejecting gun which comprises a mechanism for producing two kinds of ejecting flows which consist of a straight flow and a spray flow wherein the straight flow is ejected from an ejecting opening maintaining a constant small ejected flow area, while the spray flow is ejected from the same ejecting opening expanding radially after being ejected.

DETAILED DESCRIPTION OF THE PREFERRED EMBODIMENTS

The present invention is described in detail hereinafter in conjunction with preferred embodiments.

(First Embodiment)

This embodiment relates to a water ejecting gun which can eject a straight water flow and a spray water flow simultaneously.

Figures 1, 4:
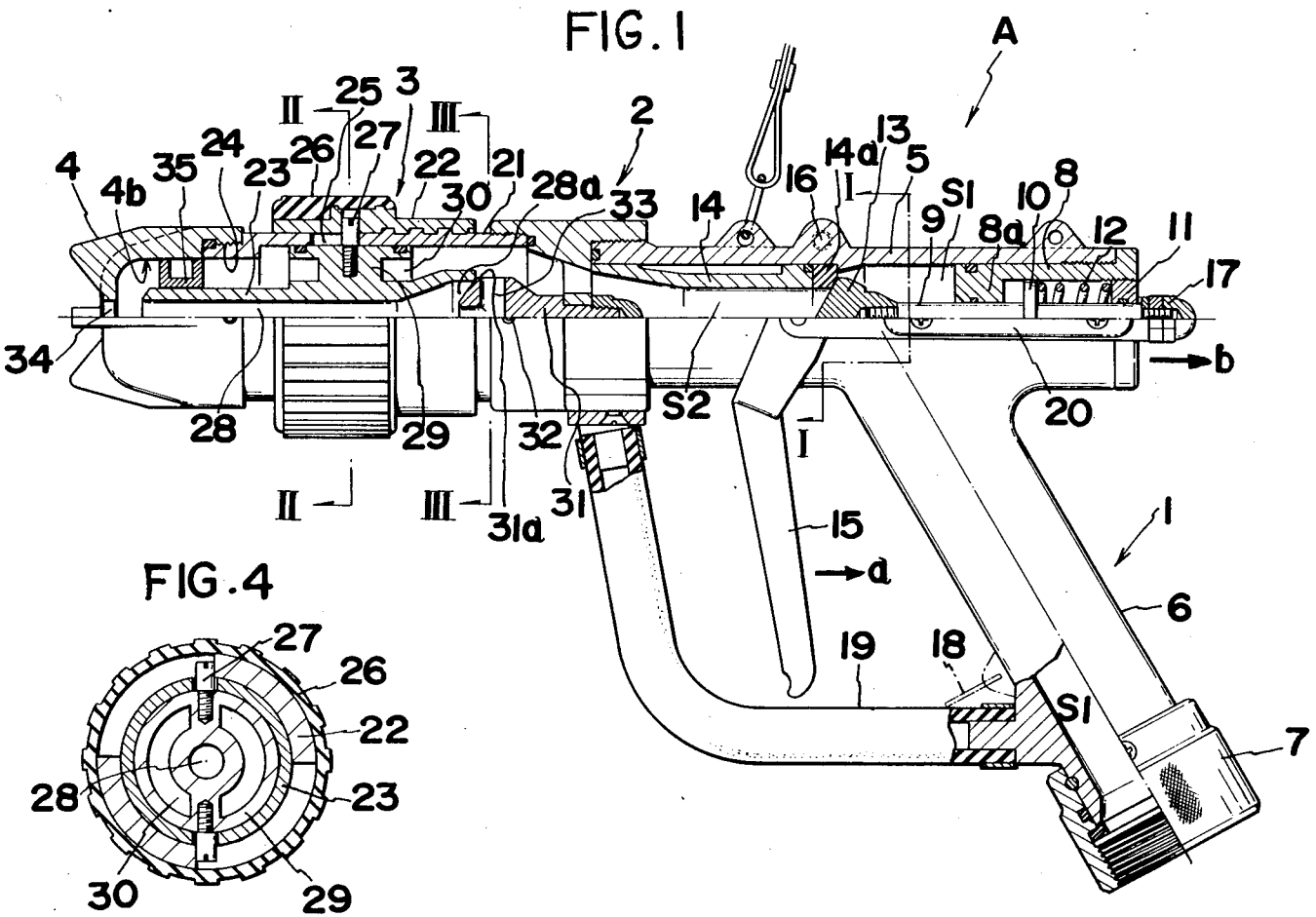
FIG. 1 is a front view partially broken away of a first embodiment of the water ejecting gun of the present invention.
FIG. 4 is a cross sectional view of the water ejecting gun taken along the line II—II of FIG. 1.

In FIG. 1, a water ejecting gun A comprises a gun body 1, an adaptor 2, an ejecting flow forming portion 3 and a head fitting 4, wherein the gun body 1 and the ejecting flow forming portion 3 are connected by the adaptor 2 and the head fitting 4 for regulating the ejecting flow is threadedly engaged with the front extremity of the ejecting flor forming portion 3.

The gun body 1 is formed like a pistol and comprises a horizontal barrel sleeve 5 and a slanted stock sleeve 6 which has the upper end thereof integrally connected to the rear portion of the horizontal barrel sleeve 5.

A swivel joint 7 for rotatably connecting a water supply hose (not shown in the drawings) to the stock sleeve 6 is mounted on the lower end of the stock sleeve 6.

A cylinder 8 is threadedly mounted on the rear end of the horizontal barrel sleeve 5 and a piston rod 9 is slidably disposed in the cylinder 8.

The cylinder 8 has an inner wall portion **8*a* at the inner end thereof and has an end plate 11 threadedly mounted on the outer end thereof, thus defining a spring loading chamber between the inner wall 8*a* and the end plate 11**.

A spring 12 is disposed in the above spring loading chamber so as to bias the piston rod 9 in a direction toward the front end of the horizontal barrel sleeve 5.

A valve element 13 is threadedly mounted on the front extremity of the piston rod 9.

To the inside of the front portion of the horizontal barrel sleeve 5, a hollow intermediate sleeve 14 is fixedly mounted and a teflon seat **14*a* is attached to the proximal end of the intermediate sleeve 14**.

The above valve element 13 rests on the teflon seat **14*a***.

Figure 3:
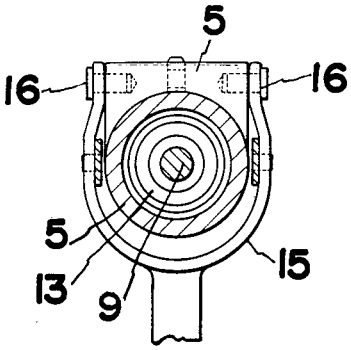
FIG. 3 is a cross sectional view of the water ejecting gun taken along the line I—I of FIG. 1.
Figure 2:
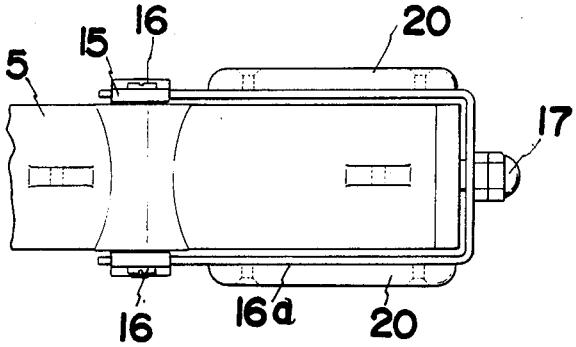
FIG. 2 is a partial plan view of the water ejecting gun of FIG. 1.

A trigger 15 has the upper ends thereof pivotally connected to the both sides of the horizontal barrel sleeve 5 by fastening bolts 16, while a U-shaped connecting frame **16*a* has one end thereof connected to the upper portion of the trigger 15 and another end connected to the protruded end of the piston rod 9 (FIG. 2 and FIG. 3**).

Due to such construction, when the trigger 15 is pulled or returned, the piston rod 9 moves axially in either a front or backward direction so as to make the valve element 13 contact with or separate from the teflon seat **14*a* of the intermediate sleeve 14. Accordingly, the water flow from the stock sleeve 6 to the ejecting water forming portion 3 can be allowed or stopped by a simple manipulation of the trigger 15**.

Referring to other elements mounted on the gun body 1, numeral 17 indicates a cap nut, numeral 18 indicates a trigger retaining ring, numeral 19 indicates an L-shaped trigger cover which has one end connected to the adaptor 2 and another end connected to the lower end of the stock sleeve 6, thus enclosing the trigger 15, and 20 indicates a pair of gun-protective plates attached to both sides of the horizontal barrel sleeve 5.

Figure 5:
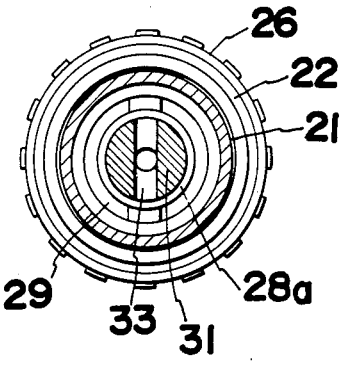
FIG. 5 is a cross sectional view of the water ejecting gun taken along the line III—III of FIG. 1.
Figure 6:
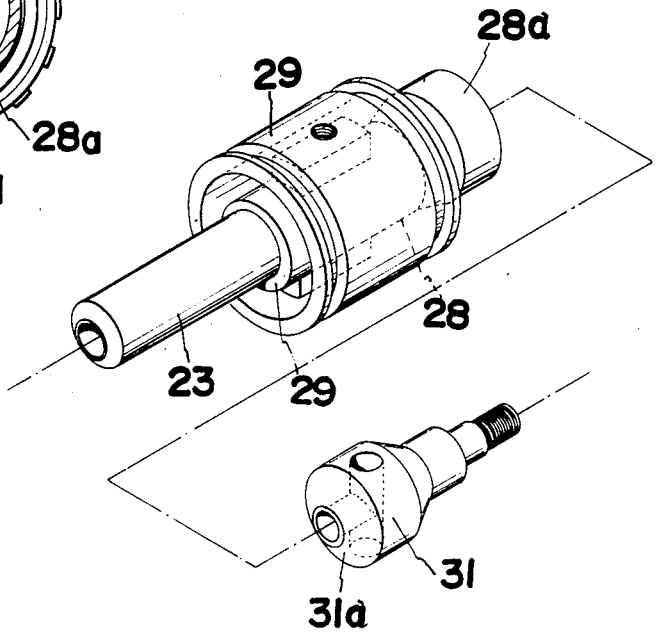
FIG. 6 is a schematic view of a part of the water ejecting gun showing the relationship between the nozzle and the core element of the water ejecting gun.

Referring now to the ejecting flow forming portion 3, the portion 3 comprises an inner sleeve 21 which has the rear end thereof mounted on the front end of the adaptor 2, an outer sleeve 22 which is rotatably and axially-movably mounted on the outer surface of the inner sleeve 21 and a nozzle element 23 concentrically disposed in the inner sleeve 21 by way of a bridge element 29 (FIG. 4 to FIG. 6).

The inner sleeve 21 is provided with an outer thread 24 on the outer surface of the front end thereof with which the head fitting 4 is meshed.

The inner sleeve 21 is also provided with elongated holes 25 which extend in an axial direction.

On the outer surface of the outer sleeve 22, a rubber-made protective cover 26 is mounted.

Guide bolts 27 pass through the elongated holes 25 and integrally connect the outer sleeve 22 with nozzle element 23 by way of the bridge 29.

Accordingly, when the outer sleeve 22 is rotated relative to the inner sleeve, the outer sleeve 22 moves in an axial direction due to the thread engagement with the inner sleeve 21 and simulaneously moves the guide bolts 27 and the elongated nozzle element 23 in the same axial direction.

The nozzle element 23 has both ends thereof open-ended and defines a straight main flow passage 28 therein.

The main flow passage 28 has the proximal end 28*a* thereof radially enlarged and another remaining portion including the distal end squeezed.

The bridge 29 disposed between the inner sleeve 21 and the nozzle element 23 is, as shown in FIG. 4, made of a circular sleeve and a pair of opposed ribs thus defining a pair of fan-shaped sub flow passages 30 therein.

A core element 31 is coaxially disposed in and fixedly attached to the adaptor 2 by a fastening bolt 32.

The front end of the core element 31 is capable of water-tightly coming into contact with the inside of the enlarged portion 28*a* of the main flow passage 28.

The core element 31 is provided with a radial passage 33 which communicates with the main flow passage 28.

The head fitting 4 is provided with an ejecting opening 34 on the front wall thereof while defining a large circular space behind the front wall.

The head fitting 4 has the proximal end thereof threaded into the other thread portion 24 of the inner sleeve 21 such that the axis of the ejecting opening 34 is aligned with the axis of the main flow passage 28.

In the above mentioned large-circular space defined in the head fitting 4, a rotating fan or agitating element 35 is disposed and is rotatably mounted on the front end of the nozzle element 23.

Thus, the water which passes through the sub flow passage 30 is turned into a spray or atomized by the rotating fan element 35 and subsequently ejected from the ejecting opening 34 of the head fitting 4 in a spray form.

The manner in which the above water-ejecting gun is operated will now be described.

Pressurized water supplied to the stock sleeve 6 of the gun body 1 is filled in the space S1 defined in the horizontal barrel sleeve 5.

When such pressurized water is to be ejected from the ejecting opening 34 of the head fitting 4, the trigger 15 is pulled in a direction of an arrow a.

In this way, the piston rod 9 is moved in a backward direction (direction of arrow b) so that a desired gap is defined between the teflon seat 14*a* and the valve element 13.

After passing through the above gap, the space S2 in the intermediate sleeve 14 and the adaptor 2, a part of the pressurized water flows into the main flow passage 28 through the flow passage 33 of the core element 31 and is ejected from the ejecting opening 34. Simultaneously, the remaining pressurized water passes through the sub flow passage 30 and is converted into a spray or atomized form and subsequently is ejected from the ejecting opening 34 in spray form.

For adjusting the ratio between the straight flow which passes through the main flow passage 28 of the nozzle element 23 and the spray flow which passes through the sub flow passage 30, the outer sleeve 22 is slid together with the protective cover 26 on and along the inner sleeve 21 so as to adjust the gap defined between the distal end 31*a* of the core element 31 and the proximal end 28*a* of the nozzle element 23. Such gap adjustment provides a bypass flow of the pressurized water into the main flow passage 28 through the gap.

Experiment

Utilizing the above water ejecting gun, when water was ejected to an object having a temperature of 800° C. at a rat of 180 liters per minute and under a pressure of 10 kg/cm$^2$, the temperature of the object was lowered to 60° C. after 30 seconds.

With the conventional water ejecting gun, even when water is ejected to an object having a temperature of 800° C. at a rate of 350 liters per minute and under a pressure of 6 kg/cm$^2$, the temperature was lowered to 60° C. after 60 seconds.

Namely, the water ejecting gun of this embodiment can disperse a water into numerous water particles having the diameter of 0.2 to 0.3 mm. Since each particle has a large surface area, the fire extinguishing efficiency and the adhesion of smoke are greatly enhanced.

Furthermore, for assuring that the ejected water can reach a long distance, the straight water is also ejected along with the above spray water from the ejecting opening 34.

Still furthermore, since the water ejecting gun of this embodiment can be used along with any commercially available fire engines or hoses, no special apparatus or equipment only applicable to the water ejecting gun of the present invention is necessary.

According to this embodiment, the water ejecting gun can extinguish fire with one-third of the water necessary for fire extinguishing operation by the conventional water ejecting gun.

Simultaneously, the water ejecting gun of this embodiment can show a remarkable effect in the fire-extinguishing operation in a closed building structure in terms of lowering the room temperature and the adhesion of the smoke.

Namely, with the provision of the straight nozzle element and the rotary fan element, the water can be ejected by a combination of a straight flow and a sprayed flow so that the water particles contained in the sprayed water can drastically lower the temperature of the fire and enhance the fire extinguishing effect and the adhesion of smoke.

Furthermore, according to this embodiment, a simple manipulation of the trigger provides the ejecting of water as well as the stoppage thereof so that the fire-extinguishing operation can be conducted easily and the damage to interiors caused by the ejected water is also reduced.

(Second Embodiment)

This embodiment is substantially characterized in that the water flow is continuously converted from the spray flow to a straight flow by varying the pulling angle of the trigger.

Figure 7:
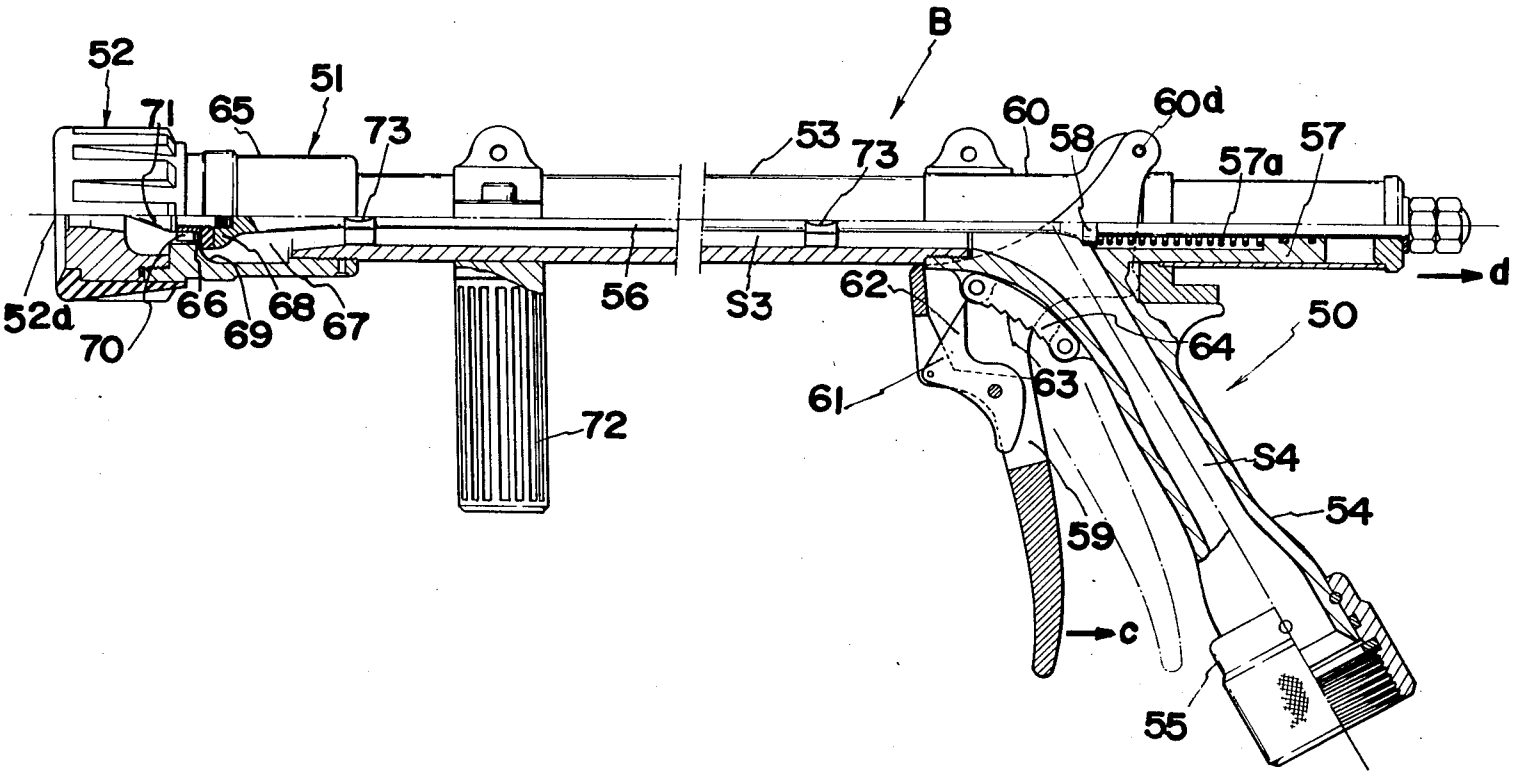
FIG. 7 is a front view partially broken away of a second embodiment of the water ejecting gun of the present invention.

In FIG. 7, a water ejecting gun B substantially comprises a gun body 50, an ejecting flow forming portion 51 and a head fitting 52.

The gun body 50 comprises a horizontal barrel sleeve 53 and a slanted stock sleeve 54 which has the upper end thereof integrally connected to the rear end of the horizontal barrel sleeve 53.

A slanted stock sleeve 54 is provided with a swivel joint 55 at the bottom end thereof for a hose connection.

In the horizontal barrel sleeve 53, an elongated gun shaft 56 is concentrically and axially-slidably disposed.

Between the inner wall of the horizontal barrel sleeve 53 and the outer surface of the elongated gun shaft 56, a flow passage S3 is defined and this flow passage S3 communicates with the flow passage S4 of the slanted stock sleeve 54.

At the rear end of the horizontal barrel sleeve 53, a spring supporting wall 57 is formed which snugly and slidably supports the gun shaft 56.

The gun shaft 56 is provided with an enlarged diameter portion 58 at a position spaced apart from the above spring supporting wall 57 and defines a spring loading space between the spring supporting wall 57 and the enlarged diameter portion 58. A spring 57*a* is disposed in the spring loading space.

Due to such construction, the gun shaft 56 is always axially biased in a direction of the front end of the horizontal barrel sleeve 53.

Numeral 59 indicates a trigger which has the upper end thereof pivotally connected to a sleeve 60 which is fixedly mounted on the horizontal barrel sleeve 53 by fastening bolts 60*a*.

The trigger 59 has a central portion thereof connected by a suitable element (not shown in the drawing) with the gun shaft 56 such that when the trigger 59 is pulled in the direction of an arrow c, the gun shaft 56 moves in the direction of an arrow d.

The trigger 59 is also provided with a stopper plate 61 which can engage a ratchet pawl 62 thereof with a plurality of ratchet teeth 63 formed on an arcuate plate 64 fixedly mounted on the slanted stock sleeve 54.

Due to such engagement, the trigger 59 can be held in any desired pulling angle until the ratchet pawl 62 is disengaged from the ratchet teeth 63.

Referring now to the flow forming portion 51, such portion 51 is substantially made of a sleeve 64 which defines a front squeezed space 66 and a rear enlarged space 67.

FIG. 7 shows the water ejecting gun at a closed position where a valve portion 68 formed on the front end of the gun shaft 56 comes into contact with an inner shoulder portion 69 of the sleeve 65 so that no water is ejected from an ejecting opening 52*a* formed in the head fitting 52.

Numeral 70 indicates a spiral which is also formed on the front end of the gun shaft 56 spaced spart from the valve portion 68, while numeral 71 indicates a cone formed on the front extremity of the gun shaft 56.

Figure 8:
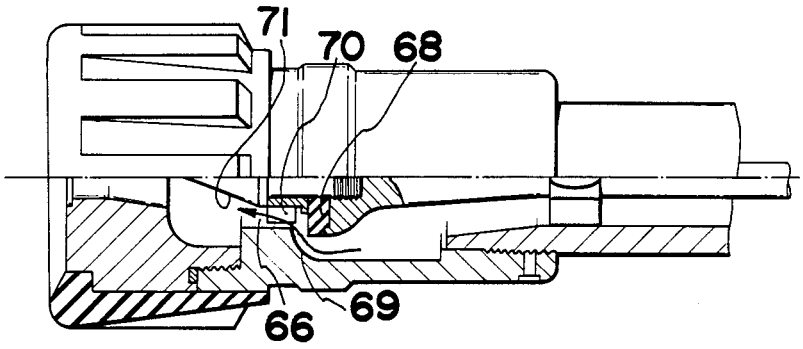
FIG. 8 is an enlarged partial front view of the water ejecting gun of FIG. 7 at a position producing a spray flow.

Due to such construction, when the trigger 59 is pulled slightly in the direction c so as to make the gun shaft 56 move slightly in the direction d, as shown in FIG. 8, the valve portion 68 is separated from the shoulder portion 69 forming a gap therebetween which allows the pressurized water to move from the horizontal barrel sleeve 53 to the head fitting 52.

However, since the spiral 70 is still disposed in the front squeezed space of the sleeve 65, the pressurized water which passes through the gap and the squeezed space is agitated or atomized and is ejected from the ejecting opening 52*a* in a spray form.

When the trigger 59 is further pulled, a part of the pressurized water is atomized by the spiral 70 and is ejected from the ejecting opening 52*a* in a spray form, while the remaining water is ejected from the same ejecting opening 52*a* in a straight flow. Namely, the mixture of the spray flow and the straight flow is ejected from the ejecting opening 52*a*.

Figure 9:
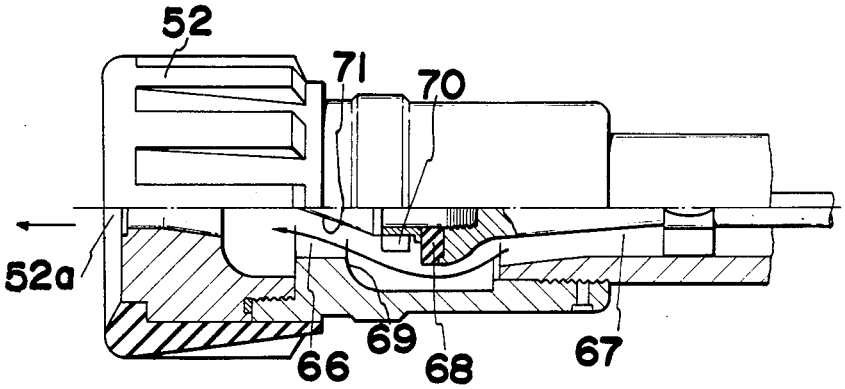
FIG. 9 is an enlarged partial front view of the water ejecting gun of FIG. 7 at a position producing a straight flow.

When the trigger 59 is completely pulled, the valve portion 68 and the spiral 70 respectively take positions as shown in FIG. 9 so that the flow of the pressurized water is not obstructed by the spiral 70 and only the straight flow is ejected from the ejecting opening 52*a* of the head fitting 52.

Referring to other elements of the water ejecting gun B of this embodiment, numeral 72 indicates a grip holder mounted on the front portion of the horizontal barrel sleeve 53 for assuring the firm supporting of the water ejecting gun B. Numeral 73 indicates cross-shaped bearings which concentrically and slidably support the gun shaft 56 within the horizontal barrel sleeve 53, while allowing the pressurized water to pass therethrough.

What we claim is:

1. A water ejecting gun comprising:

(a) a pistol-shaped gun body comprising a hollow horizontal barrel sleeve having a spray end and a hollow slanted stock sleeve integrally connected to said hollow horizontal barrel sleeve at a point spaced from the spray end, (b) an ejecting flow-forming portion connected to the spray end of said horizontal barrel sleeve, said ejecting flow-forming portion having an upstream end and a downstream end and including a mechanism for producing a straight flow and a spray flow, said mechanism for producing a straight flow and a spray flow comprising, (i) an inner sleeve having an upstream end connected to the spray end of said horizontal barrel sleeve by means of a sleeve-like adaptor, said inner sleeve having an inner wall and a peripheral wall extending in an axial direction and at least one elongated bolt-guiding hole extending through said peripheral and inner walls, (ii) an outer sleeve rotatably and axially movably mounted on said inner sleeve, (iii) A sleeve-like nozzle element having a downstream end and an outer periphery concentrically disposed in said inner sleeve defining a nozzle passage having an upstream opening, said nozzle passage having a straight main flow passage inside said inner sleeve for said straight flow and a sub-flow passage for said spray flow between said outer periphery and said inner wall of said inner sleeve, said sub-flow passage communicating with the inside of said horizontal barrel sleeve, said nozzle element having an upstream end larger in diameter than said downstream end, (iv) a core element disposed in and fixed to said sleeve-like adaptor, said core element having a frusto-conical downstream end for coming into and out of contact with the nozzle element at the upstream opening of said nozzle passage, a circular gap being formed between the upstream opening of said nozzle passage and said frusto-conical downstream end of said core element when said core element does not contact said nozzle element, said circular gap allowing water into said straight main flow passage to produce said main straight flow, said core element including a radial passage upstream of said frusto-conical downstream end communicating with an axial passage extending through said frusto-conical downstream end for permitting a reduced flow of water from inside said horizontal barrel sleeve to said straight main flow passage in said nozzle element, even when no water flows through said gap, for ejecting some water onto a central portion of a target to be sprayed along with said spray flow, (v) at least one guide bolt passing through said elongated bolt-guiding hole and connecting said nozzle element with said outer sleeve for simultaneously axially moving said nozzle element relative to said core element to regulate the size of said circular gap between said core element and said nozzle element, thereby water flows through said gap into said straight main flow passage of said nozzle element, (vi) a rotary fan element rotatably mounted at the downstream end of said nozzle element on said outer periphery, and (vii) a head fitting mounted on the downstream end of said ejecting flow-forming portion, said head fitting defining an ejecting opening having a diameter almost equal to a diameter of said main flow passage, said ejection opening communicating with said nozzle element for ejecting said straight flow and said spray flow simultaneously from said ejecting opening, said straight flow acting as a carrier for said spray flow, whereby, corresponding to the movement of said nozzle element relative to said core element, the gap between said upstream opening of said nozzle passage and said frusto-conical downstream end of said core element is adjusted so that the amount of water for said straight flow is regulated while the distance the spray flow and straight flow is ejected from said ejecting opening is readily changeable, thus insuring effective spraying without extraneous damage.

* * * * *